US008494861B2

(12) United States Patent
Robb et al.

(10) Patent No.: US 8,494,861 B2
(45) Date of Patent: Jul. 23, 2013

(54) MOVABLE BARRIER CONTROL SYSTEM COMPONENT WITH AUDIBLE SPEECH OUTPUT APPARATUS AND METHOD

(75) Inventors: Eric J. Robb, Bolingbrook, IL (US); Eric Gregori, Lindenhurst, IL (US); Robert Daniel-Wayman, Lombard, IL (US); James J. Fitzgibbon, Batavia, IL (US)

(73) Assignee: The Chamberlain Group, Inc., Elmhurst, CA (US)

( * ) Notice: Subject to any disclaimer, the term of this patent is extended or adjusted under 35 U.S.C. 154(b) by 1145 days.

(21) Appl. No.: 10/843,237

(22) Filed: May 11, 2004

(65) Prior Publication Data

US 2005/0256718 A1 Nov. 17, 2005

(51) Int. Cl.
*G10L 11/00* (2006.01)
*G10L 21/00* (2006.01)

(52) U.S. Cl.
USPC ..... 704/275; 704/270; 704/273; 340/501; 340/521; 318/268

(58) Field of Classification Search
USPC .... 704/274, 275, 260; 340/521, 501; 318/268
See application file for complete search history.

(56) References Cited

U.S. PATENT DOCUMENTS 4,408,251 A 10/1983 Kaplan
4,520,576 A * 6/1985 Vander Molen ..... 34/534
4,821,027 A * 4/1989 Mallory et al. ..... 340/521
4,904,993 A * 2/1990 Sato ..... 340/12.5
5,429,399 A 7/1995 Geringer et al.
5,565,843 A 10/1996 Meyvis
5,630,017 A 5/1997 Gasper et al.
5,680,134 A 10/1997 Tsui
5,841,390 A 11/1998 Tsui
5,986,561 A 11/1999 Kuruvilla et al.
6,005,508 A 12/1999 Tsui
6,051,947 A 4/2000 Lhotak et al.
6,064,303 A * 5/2000 Klein et al. ..... 340/506
6,104,334 A 8/2000 Allport
6,111,374 A 8/2000 Fitzgibbon et al.

(Continued)

FOREIGN PATENT DOCUMENTS

EP 1 280 109 A2 1/2003
EP 1 349 146 A1 10/2003

(Continued)

OTHER PUBLICATIONS

"Ademco 5804 BDV-CN Wireless 4 Button Key Fob with Voice Feedback." 1pg Apr. 28, 2004. <http://www.electronicproductonline.com/catalog/product_info.php?cPath=31_40&Product . . . >.

(Continued)

*Primary Examiner* — Talivaldis Ivars Smits
*Assistant Examiner* — Shaun Roberts
(74) *Attorney, Agent, or Firm* — Fitch Even Tabin & Flannery LLP

(57) ABSTRACT

An automated movable barrier control system component (11) as comprises a part of a movable barrier control system (10) has an audible speech output device (21) operably coupled thereto. These elements can share a common housing (22). The audible speech output device (21) can audiblize one or more items of stored speech content relating to one or more aspects of the component itself, other components within the system, and/or the system itself.

75 Claims, 3 Drawing Sheets

U.S. PATENT DOCUMENTS

| | | | | |
|---|---|---|---|---|
| 6,130,620 | A * | 10/2000 | Pinnow et al. | 340/5.86 |
| 6,184,787 | B1 * | 2/2001 | Morris | 340/521 |
| 6,278,249 | B1 * | 8/2001 | Fitzgibbon et al. | 318/268 |
| 6,344,817 | B1 | 2/2002 | Verzulli | |
| 6,388,412 | B1 | 5/2002 | Reed et al. | |
| 6,397,186 | B1 | 5/2002 | Bush et al. | |
| 6,519,049 | B1 | 2/2003 | Nagasaka | |
| 6,624,605 | B1 * | 9/2003 | Powder et al. | 318/445 |
| 6,650,248 | B1 | 11/2003 | O'Donnell et al. | |
| 6,661,340 | B1 * | 12/2003 | Saylor et al. | 340/517 |
| 6,741,052 | B2 | 5/2004 | Fitzgibbon | |
| 7,013,355 | B2 | 3/2006 | Chambers | |
| 7,111,788 | B2 | 9/2006 | Reponen | |
| 7,123,128 | B2 | 10/2006 | Mullet et al. | |
| 7,181,203 | B2 | 2/2007 | Gregori | |
| 7,194,412 | B2 * | 3/2007 | Mays | 704/275 |
| 7,207,142 | B2 | 4/2007 | Mullet | |
| 7,750,890 | B2 | 7/2010 | Fitzgibbon et al. | |
| 2002/0135461 | A1 | 9/2002 | Nuesser et al. | |
| 2003/0018478 | A1 * | 1/2003 | Mays | 704/275 |
| 2003/0023881 | A1 | 1/2003 | Fitzgibbon et al. | |
| 2003/0028380 | A1 * | 2/2003 | Freeland et al. | 704/260 |
| 2003/0034898 | A1 | 2/2003 | Shamoon et al. | |
| 2005/0151622 | A1 | 7/2005 | McMahon | |
| 2005/0176400 | A1 | 8/2005 | Mullet et al. | |
| 2006/0158344 | A1 | 7/2006 | Bambini et al. | |
| 2010/0238117 | A1 | 9/2010 | Fitzgibbon | |

FOREIGN PATENT DOCUMENTS

| | | |
|---|---|---|
| GB | 2 402 431 A | 12/2004 |
| GB | 2 408 063 | 5/2005 |
| GB | 2 402 434 | 12/2008 |
| WO | WO 94/28675 | 12/1994 |
| WO | WO 01/47130 | 6/2001 |

OTHER PUBLICATIONS

British Search Report Under Section 17 Relative to GB0509538.5 Dated Jul. 13, 2005.

British Patent Application No. GB0509537.7; British Search Report Under ection 17 Dated Sep. 21, 2005.

U.S. Appl. No. 12/794,366; Response to Office Action Dated Sep. 9, 2011.

* cited by examiner

MOVABLE BARRIER CONTROL SYSTEM COMPONENT WITH AUDIBLE SPEECH OUTPUT APPARATUS AND METHOD

FIELD OF THE INVENTION

This invention relates generally to movable barrier control systems.

BACKGROUND OF THE INVENTION

Movable barrier operator systems of various kinds are known in the art. In general, such systems serve to effect selective movement of a movable barrier (including but not limited to garage doors of various kinds, rolling shutters, and other horizontally or vertically sliding, moving, or pivoting doors, gates, arms, and the like) between at least a first position and a second position (such as between an opened and a closed position). Many such systems include at least one and frequently a plurality of movable barrier operator system components. Such components serve in general to instigate and/or to reflect or report active operation of the system in general and often (but not always) more specifically the active operation of the movable barrier itself. Examples of such components include but are not limited to movable barrier operators and movable barrier operator remote control devices (including wired and wireless remote control devices and portable and stationary remote control devices).

The operational strategies, component configuration and deployment, installation requirements, and feature sets of such systems continues in general to grow in complexity. At the same time, however, many users are unable or unwilling to make effective use of a challenging user interface. As a result, many modern movable barrier operator systems that support a variety of functions and operational states nevertheless offer only a very limited user interface. For example, in many cases, the individual components provide little or no informational content to a user. In some cases one or two light emitting diodes or other similar indicator serves to indicate when a particular button has been pushed or some corresponding action has been instigated, but generally speaking, such systems are literally silent in this regard.

While such design strictures do, in at least some sense, often succeed in maintaining potential user cognitive loading at or below some desired level, these same user interface conditions also potentially unduly constrain the breadth and/or depth of system functionality, ease of use, and capability. This, in turn, can ultimately lead to reduced user satisfaction.

BRIEF DESCRIPTION OF THE DRAWINGS

The above needs are at least partially met through provision of the movable barrier control system component with audible speech output apparatus and method described in the following detailed description, particularly when studied in conjunction with the drawings, wherein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION OF THE INVENTION

Generally speaking, pursuant to these various embodiments, one or more movable barrier control system components are operably coupled to an audible speech output device. For example, a movable barrier operator and/or a fixed-location remote control user interface can be coupled in this fashion to an audible speech output device. So configured, and pursuant to a preferred approach, predetermined speech content can be provided in response to detection of a predetermined trigger event. (In a preferred approach, such predetermined trigger events include trigger events other than events that correspond to an interactive speech recognition activity.)

So configured, audible speech content can be provided to inform and/or assist a system user or installer. This speech content can serve as a natural and relatively intuitive interface for the provision of warnings, notices, instructions, and help. This capability can also serve, if desired, to facilitate individualization of a given system deployment and/or increased user enjoyment experience.

These and other benefits will become more evident to those skilled in the art upon making a thorough review and study of the following detailed description.

Figure 1:
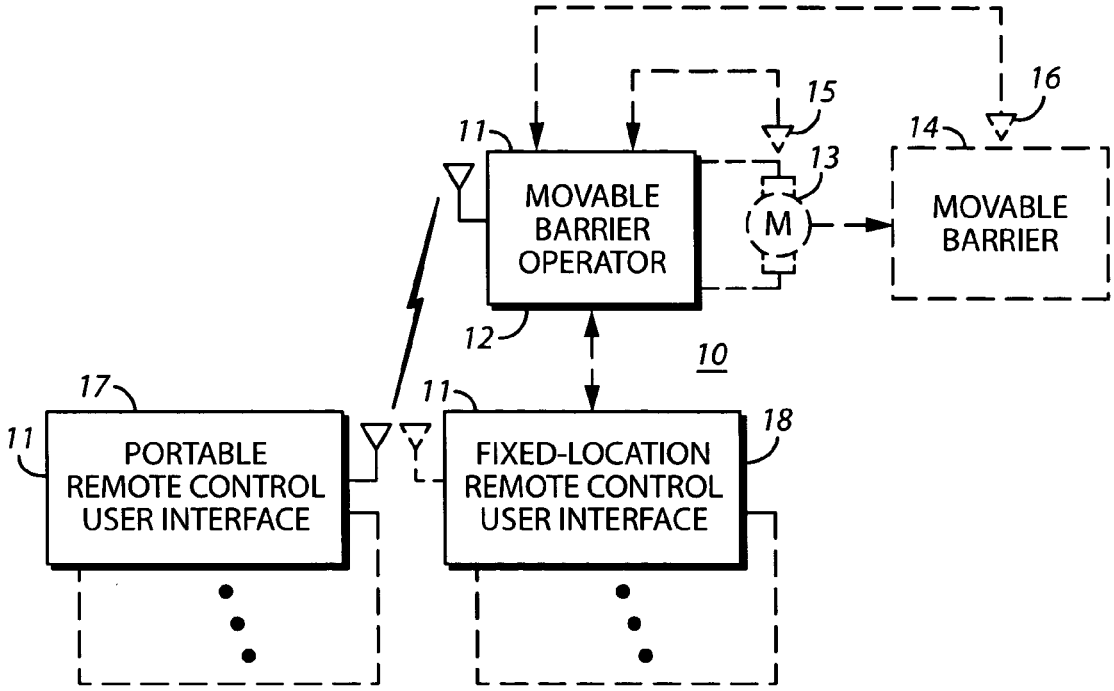
FIG. 1 (Prior Art)
FIG. 1 comprises a block diagram as configured in accordance with prior art practices.

Referring now to the drawings, and in particular to FIG. 1, a typical automated movable barrier control system 10 will comprise one or more automated movable barrier control system components 11. One such automated movable barrier control system component 11 will usually comprise a movable barrier operator 12. The movable barrier operator 12 will typically couple to and otherwise control the operation of a motor 13 or other motive force platform that in turn controls movement of a corresponding movable barrier 14. In many cases one or more sensors serve to provide the movable barrier operator 12 with useful information regarding the operation of the system. As a non-exhaustive illustration, a first sensor 15 often provides information regarding operation of the motor 13 (for example, revolutions per minute as correspond to an output shaft of the motor 13) and/or a second sensor 16 may provide information regarding the movable barrier 14 itself (such as its present position or its present proximity to a known position or object).

Such an automated movable barrier control system 10 will also often comprise one or more remote control user interfaces. There are typically two such kinds of interfaces; there may be one or more portable remote control user interfaces 17 and there may be one or more fixed-location remote control user interfaces 18. Portable interfaces 17 are typically battery powered and usually communicate with one or more corresponding movable barrier operators 12 via a wireless communication link. Fixed-location remote control user interfaces 18, such as wall-mounted remote control user interfaces, communicate with a corresponding movable barrier operator(s) 12 via a wireless communication link and/or a hard-wired communication link (such as but not limited to a single signal carrying conductor, a two-wire serial data path, an optical signal path (such as an optical fiber path), and so forth). So configured, a user can provide instructions to a movable barrier operator 12 even while being remotely disposed with respect to that movable barrier operator 12.

The above system elements and their mode and range of operation are well known in the art. Because of this, and further because the teachings set forth below are not particularly sensitive to a given choice of system platform or operating strategy, additional details regarding such system elements will not be provided here for the sake of brevity and clarity.

Figure 2:
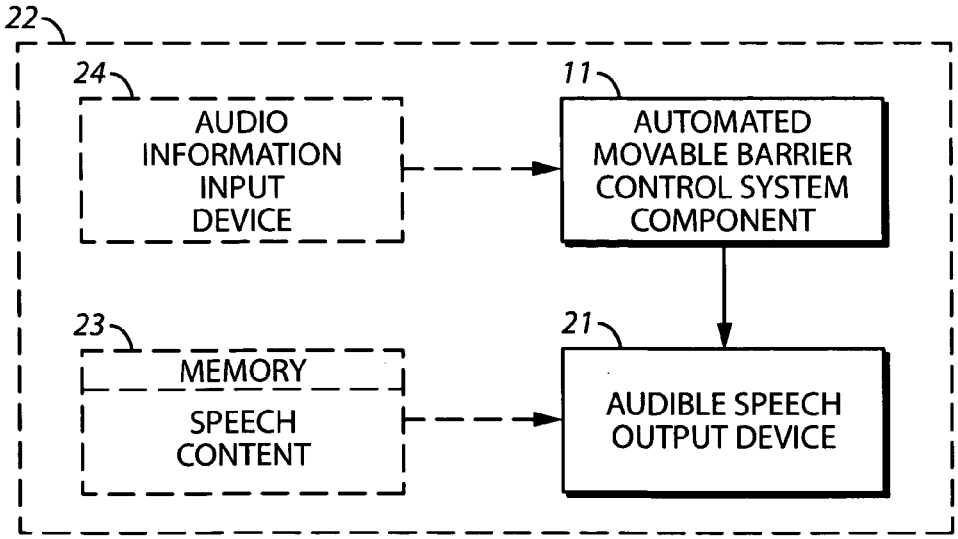
FIG. 2 comprises a block diagram as configured in accordance with various embodiments of the invention.

Referring now to FIG. 2, the automated movable barrier control system component 11, in a preferred embodiment, will operably couple to an audible speech output device 21. The audible speech output device 21 can comprise any of a wide variety of presently known or hereafter-developed platforms including but not limited to digitized voice audible speech output devices and synthesized voice audible speech output devices as are well understood in their respective art. In a preferred approach the automated movable barrier control system component 11 and the audible speech output device 21 will share a common housing 22. Depending upon the form factor of the audible speech output device 21, the latter may be partially or fully encompassed by such a housing 22, or may be supported on an external surface of the housing 22. The housing itself can be comprised on any material or materials as may suit the needs and requirements of a given application but will typically be comprised, in whole or in part, of plastic.

Pursuant to some embodiments, the audible speech output device 21 operably couples to one or more memories 23. This memory 23 has speech content stored therein. For example, when the audible speech output device 21 comprises a digitized voice audible speech output device, this speech content can comprise corresponding digitized speech content. Similarly, when the audible speech output device 21 comprises a synthesized voice audible speech output device, this speech content can comprise corresponding speech synthesis parameters and data (wherein the data can comprise, for example, text when the audible speech output device further comprises a text-to-speech synthesizer as is also understood in the art). So configured, the audible speech output device 21 can access this memory 23 to obtain data that the audible speech output device 21 can compatibly convert to audible speech. (Those skilled in the art will recognize that this memory can be formed, in whole or in part, integral to the audible speech output device 21, the automated movable barrier control system component 11, or can be deployed in a discrete fashion as is suggested by the illustration.)

In a preferred embodiment, this stored speech content comprises at least one, and preferably a plurality, of predetermined messages. (Those skilled in the art will recognize that such predetermined messages can each comprise a discretely stored message (i.e., where each message is audibly and substantively complete in and of itself) or each can comprise a combination of smaller message units (such as individual phrases, words, syllables, consonants/vowels, or the like).)

Such messages can comprise any of a wide variety of information content, including but not limited to such examples as:

information regarding an operating condition as corresponds to an automated movable barrier control system (such as a present position status of the movable barrier, speed or direction of movement of the movable barrier, present maximum force settings, motor temperature, availability of electrical power, operational linkage between a movable barrier operator and one or more remote interfaces, and so forth);

information that explains a given action (including automated actions) of an automated movable barrier control system (such as obstacle detection results, vacation mode settings, present maximum force settings or sensed applied force, motor temperature, and so forth);

information that corresponds to installation of an automated movable barrier control system (such as step-by-step physical installation instructions, confirmation of automated or user-initiated calibration actions, prompts to urge an installer to take a particular action or to acknowledge completion of a given step or task, measured values (such as measurements corresponding to required applications of force, position and/or distance information with respect to travel of a movable barrier operator, passpoint positioning, and so forth), options and features settings and status, and so forth);

information regarding the automated movable barrier control system component itself (such as user-input acknowledgement or confirmation, user prompts, operational status information, calculated battery life expectancy, and so forth);

information regarding an aspect of an automated movable barrier control system component other than this automated movable barrier control system (such as presence information, corresponding user identification, authorization data (such as time or cycles remaining until expiration of that component's temporarily granted authorization), communications statistics and experience, and so forth); and information comprising a warning or other cautionary representation regarding the automated movable barrier control system (such as detection of an obstacle in the path of the movable barrier, excessive motor temperature, excessive applied force or movable barrier speed of movement, unauthorized movement of the movable barrier, and so forth); to name a few.

Such messages can be provided in any appropriate form. For example, a given message can comprise a declaratory statement while another message can comprise a question. The latter can be particularly effective when seeking to elicit a corresponding response from an installer or user. For example, the question, "Have you completed Step 1?" can be posed after providing instructions regarding how to accomplish this step in order to determine whether and when to provide information regarding a next sequential step in an installation process.

Such messages can also be provided in any appropriate voicing. For example, a human-sounding voicing can be applied or a non-human-sounding voicing can be used as desired. The voicing can be gender neutral or can be gender recognizable (for example, the audible speech content can be recognizable as indicative of male or female voiced content). The voicing can also be identity-specific or identity-neutral. When identity-neutral, the voicing is essentially unrecognizable as owing to any particular known speaker. When identify-specific, the voicing is recognizable as having been spoken by a particular known speaker. For example, the speech content can comprise audible content as provided by (or modeled after) a given celebrity's speech. As another example, the speech content can comprise audible content as provided by the installer or the user themselves (where, for example, such an individual essentially records their own speech content for use as described herein).

Other variations exist with respect to such stored speech content. In addition to comprising a plurality of messages that differ from one another with respect to substantive content as regards a given automated movable barrier control system (or some selected sub-system pertaining thereto), one or more of these messages can be selected only for use in a given operating context or with a given operating platform. For example, the memory 23 may contain speech content that, in the aggregate, contains substantive content suitable for use with any model of component as may be offered by a given manufacturer (or industry group). The audible speech output device 21 and/or the component 11 itself, however, may use only a portion of that total quantity of message content as is appropriate and relevant to the capabilities, features, and or deployment particulars that pertain to that given device 21 and/or component 11. Therefore, depending upon the needs and requirements of a given situation, such stored messages can differ from one another (either substantively or with respect to application or use) with respect to one or more of:

an on-board operating system for the component;

an on-board operating system version for the component;

an on-board user interface capability (such as availability of speech recognition input, touchscreen display, a full-alphanumeric keypad, a printer, and so forth);

a brand of manufacture (as may be helpful and useful when providing a component designed and intended to work compatibly with differing products from different manufacturers);

a product model; and/or a characterizing trademark (as may be helpful and useful when providing a common speech content set for use with a product line where feature differentiation correlates, at least in part, to a branding strategy and trademark practices).

It would also be possible to provide messages comprising different versions or expressions of a shared substantive meaning. For example, this could accommodate permitting a user to select a terse messaging style (with messages such as "Warning!") or a more informative messaging style (with messages such as "Please be careful. The door is now closing."). This approach would not only permit the use of messages having a same substantive message content but having alternative wording, but would also accommodate the storage and availability of messages having a same substantive message content but as delivered in alternative languages. For example, both "Warning!" and "Avertissement!" could be stored to express the same substantive notion in both English and French.

When such alternatives are available, in some instances a given alternative or set of alternatives should preferably be set automatically by the automated movable barrier control system component 11, the audible speech output device 21, or some other system element. Such automated selection well suits a situation when alternatives or other selections are designed to accord with variations regarding a given component's or system's own features and capabilities. In other cases, it may be useful and appropriate to provide an interface such that a user can select a given set of messages or a specific alternative or style of alternatives. Such flexibility well suits a situation when the alternative or other selections are designed to accommodate personal preferences.

In many cases the automated movable barrier control system component will include some form of user input interface such as one or more buttons, switches, and the like. In many cases this can be adequate to serve anticipated needs. For some purposes, however, it may be desired to operably couple an audio information input device 24 to, for example, the automated movable barrier control system component 11. Such an audio information input device 24 can comprise, for example, a speech recognition input device in accord with well understood prior art practice. Such a speech recognition input device can be speaker-dependent and/or speaker-independent, again in accord with well understood prior art technique and methodology.

So configured, a user can provide information to the automated movable barrier control system component 11. Such information can be audibly provided in response to, for example, audiblized spoken prompts as provided to the user via the audio speech output device. Other possibilities also exist. For example, when two components 11 within a given system 10 both have audible speech output devices 21 and audio information input devices 24, they can communicate with one another via an exchange of speech. In such a case, the pre-stored messages may comprise, or at least include, spoken messages intended for receipt and processing by a system component rather than by a user or installer. Such techniques can be used, for example, to permit such devices to confirm their mutual presence to one another and to then configure themselves in an appropriate corresponding fashion.

The audible speech output device 21 itself will typically comprise a suitable translation platform to convert the stored speech content into an audible format. For example, when the stored speech content comprises digitized speech samples, the audible speech output device 21 would typically include a digital-to-analog converter to convert such a digital representation into a corresponding audio signal. The audible speech output device 21 will also likely usually include one or more amplification stages to raise the level of the resultant audio signal to an appropriate power level. Other processes, such as compression, equalization, filtering, and so forth can also be accommodated as desired. Audio signal processing generally comprises a well-understood area and additional details will therefore not be provided here.

Figure 3:
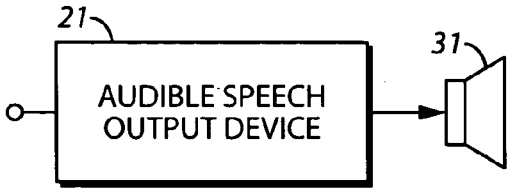
FIG. 3 comprises a block diagram as configured in accordance with various embodiments of the invention.

The audible speech output device 21 may, or may not, necessarily include an audio transducer. Pursuant to some embodiments, and referring now to FIG. 3, the audio speech output device 21 may couple to a corresponding speaker 31. The speaker 31 itself may be housed within or otherwise supported by the earlier-mentioned housing 11. So configured, the speaker 31 will convert the audio electrical signals from the audio speech output device 21 into acoustic waves that are discernable as verbalized speech by a listener.

Figure 4:
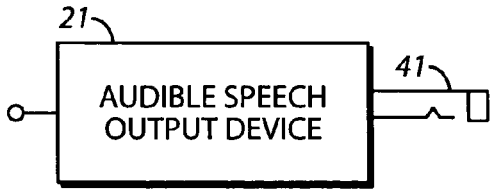
FIG. 4 comprises a block diagram as configured in accordance with various embodiments of the invention.

Pursuant to another approach (See FIG. 4), the audio speech output device 21 may operably couple to an electrical signal output port 41 such as a headphone jack. Such headphone jacks are well known in the art and provide an physical and electrical point of contact to permit a pair of headphones to be operably coupled to the audio signal output of the audio speech output device 21. This would permit, for example, an installer to wear headphones and hear the verbalized messages as output by the audio speech output device 21. Such an electrical signal output port 41 can be provided alone or in conjunction with provision of one or more speakers 31 as described above.

Figure 5:
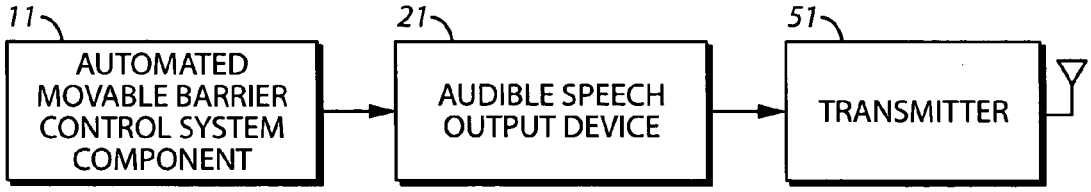
FIG. 5 comprises a block diagram as configured in accordance with various embodiments of the invention.

Pursuant to yet another embodiment (See FIG. 5), the audio speech output device 21 may operably couple to a transmitter 51. This transmitter 51 can comprise a modulated wireless signal transmitter such as, but not limited to, a radio frequency transmitter. Any known or hereafter-developed modulation technique can likely be employed including both frequency modulation and amplitude modulation. In general, this transmitter 51 will likely comprise a short-range transmitter (have an effective coverage radius of, for example, less than 300 meters) though longer-range platforms could be used if so desired. So configured, the audible speech output of the audio speech output device 21 could be transmitted, for example, and received and rendered audible by a vehicle-mounted receiver. This, in turn, would permit audible messages sourced by the system component 11 to be heard from inside a vehicle that is entering, leaving, or otherwise parked within a corresponding garage.

Other forms of wireless communication could also be utilized if desired. This would include, but not be limited to, optical signal-based communications (using, for example, an infra-red carrier) and audio signal-based communications (using, for example, an ultrasonic or supersonic carrier) as are well understood in the art.

Figure 6:
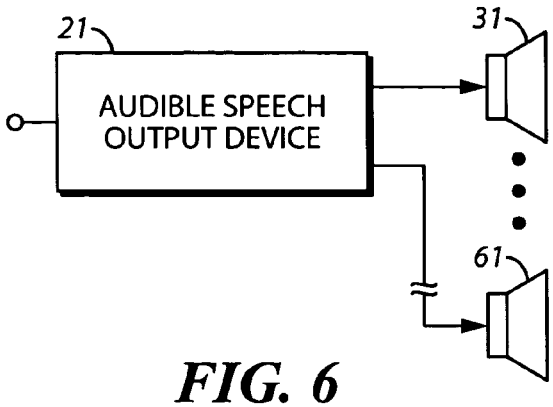
FIG. 6 comprises a block diagram as configured in accordance with various embodiments of the invention.

Referring now to FIG. 6, it would also be potentially useful in at least some operational settings to provide at least a second speaker 61 in addition to a first provided speaker 31. This could be used to support the playback of stereophonic audio content. Or, if desired, the second speaker 61 could be disposed relatively distal to the audio speech output device 21 while the first speaker 31 is disposed relatively proximal to the audio speech output device 21. This would permit the audio messages to be provided on a widespread basis without necessarily requiring a single audio source to operate at high power levels. For example, these supplemental speakers could be located at various locations within and external to a given garage to ensure that the messages were audible at all such locations. Or, if desired, different audio content could be provided to different speakers, such that one speaker relates a first given message while a second speaker relates either no message or a second given message.

If desired, one or more of these audiblized speech output options can be used in conjunction with other output mechanisms as well. For example, a display mechanism can be provided to facilitate the provision of textual or graphic informational content to a nearby user. (Further details regarding supporting embodiments and use of display mechanisms in a movable barrier operator system are set forth in a patent application entitled MOVABLE BARRIER OPERATOR SYSTEM DISPLAY METHOD AND APPARATUS filed on even date herewith U.S. patent application Ser. No. 10/843,222, the contents of which are fully incorporated herein by this reference.) When providing such facilities, it will likely often be useful to provide a selection mechanism to permit a user to select which information output approaches to use (alone or in combination with one another) for given corresponding functions and/or periods of time. Then, in conjunction with the information output approaches, a user can interact with the movable barrier control system component 11 to effect alteration of system settings such as force, time, and code settings. For example, a user might select a "FORCE" feature to effect a user-defined alteration of an automatically-set maximum force setting as used in an obstacle detection scheme. The user can then effect an "UP" instruction or "DOWN" instruction through the movable barrier control system component 11 to increase or decrease the FORCE setting for the movable barrier operator system.

Figure 7:
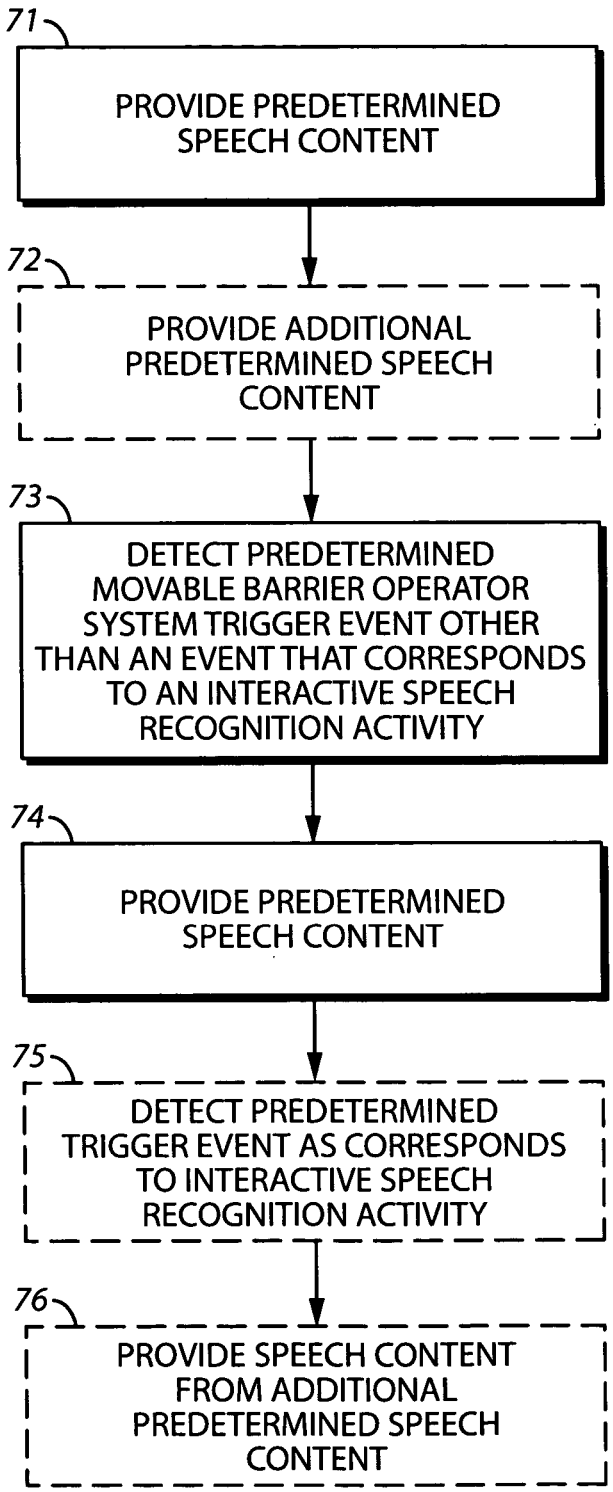
FIG. 7 comprises a flow diagram as configured in accordance with various embodiments of the invention.

Various of these embodiments, or such other enabling platform as may be desired and available to a given system designer, can be used to support various corresponding processes. In general, and referring now to FIG. 7, such a process 70 can provide 71 predetermined speech content as related above. If desired, this process 70 will also accommodate the provision of non-speech audio content as well (such as, for example, various alert tones and sounds or other sound effects, musical passages, barking dogs, and the like). In general, this predetermined speech content corresponds to activities other than interactive speech recognition activity. If desired, however, this process 70 can also optionally provide 72 for additional predetermined speech content as corresponds to an interactive speech recognition activity.

The process 70 then detects 73 when one or more predetermined trigger events as correspond to the movable barrier operator system occur (again, wherein such predetermined trigger events do not comprise events that correspond to an interactive speech recognition activity). These predetermined trigger events can be many and varied and can correspond to essentially any aspect of, or regarding, a movable barrier controller system. As but a few illustrative examples, suitable trigger events can comprise:

receiving a signal from a movable barrier operator (regarding, for example, actions taken by that operator, a present status of that operator, available operating modes, and so forth);

detecting a failure of a movable barrier operator or some corresponding component or system;

detecting activation of an alarm condition;

detecting a warning state for a movable barrier operator;

detecting automatic activation of a movable barrier operator; and detecting user input (as entered, for example, via a pressure-responsive user interface such as a touch screen display, a button, or a switch); to name a few.

In response to detecting such a trigger event, the process 70 then provides 74 at least a portion of the predetermined speech content. As described above, preferably, this predetermined speech content is presented in audible form. By one approach, a relatively generic audible message can be provided in response to any of a plurality of sensed trigger events. In a preferred approach, however, an appropriate context-sensitive selection of a given message will be effected when sensing a given trigger event. So configured, a specific verbal message conveying a trigger-specific communication can be offered for each of a plurality of predetermined trigger events.

As noted earlier, predetermined speech content particularly intended for use in an interactive speech recognition exchange can also be optionally provided. When available, this process 70 can further provide for detection 75 of predetermined trigger events as correspond to such an interactive speech recognition activity and the subsequent provision 76 of responsive speech content from the additional predetermined speech content.

In general, the provision of audiblized speech when joined in conjunction with one or more movable barrier operator system components yields numerous benefits. The resultant ease of communication (both outwardly and in support of interactive communications) can be readily leveraged to permit more reliable installation or use of one or more components of a movable barrier operator system, a greater breadth and depth of operating features and options, and improved security, reliability, and enjoyment of use.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. An apparatus including a movable barrier control system, the apparatus comprising:

a movable barrier control system component operably coupled to an audible speech output device, the movable barrier control system component comprising a fixed-location remote control user interface separate from and in responsive communication with a movable barrier operator;

the audible speech output device operably coupled to the movable barrier control system component to be actively responsive to communications received from the movable barrier operator to produce an audible signal, the audible signal having an informational content associated with at least two system operational aspects of the movable barrier control system and not associated with interactive speech recognition activity of the moveable barrier control system;

memory that operably couples to the audible speech output device, the memory including speech content which includes a plurality of predetermined messages which comprise at least a first message as corresponds to first substantive content and a second message as corresponds to second substantive content, wherein the first and second substantive content are different from one another and wherein the first message corresponds to a first movable barrier control system component and the second message corresponds to a second movable barrier control system component, wherein the first and second movable barrier control system components are different from one another, the movable barrier control system component configured to effect an operation of the movable barrier control system and alteration of at least one of the system operational aspects of the movable barrier control system selected from the group consisting of:

maximum force settings;

operational linkage between the movable barrier operator and one or more remote interfaces;

vacation mode settings;

calibration actions; and authorization data.

2. The apparatus of claim 1 wherein the movable barrier control system component comprises a movable barrier operator.

3. The apparatus of claim 1 wherein the fixed-location remote control user interface comprises a wall-mounted remote control user interface.

4. The apparatus of claim 1 wherein the fixed-location remote control user interface comprises a wireless fixed-location remote control user interface.

5. The apparatus of claim 1 wherein the fixed-location remote control user interface comprises a hard-wired fixed-location remote control user interface.

6. The apparatus of claim 1 wherein the audible speech output device and the movable barrier control system component share a common housing.

7. The apparatus of claim 1 wherein the audible speech output device comprises a digitized voice audible speech output device.

8. The apparatus of claim 1 wherein the audible speech output device comprises a synthesized voice audible speech output device.

9. The apparatus of claim 1 wherein the audible speech output device comprises a speaker.

10. The apparatus of claim 1 wherein the audible speech output device comprises an electrical signal output port.

11. The apparatus of claim 1 wherein the audible speech output device comprises a modulated wireless signal transmitter.

12. The apparatus of claim 11 wherein the modulated wireless signal transmitter comprises a radio frequency transmitter.

13. The apparatus of claim 12 wherein the radio frequency transmitter comprises a frequency modulation radio frequency transmitter.

14. The apparatus of claim 13 wherein the frequency modulation radio frequency transmitter comprises a short-range transmitter.

15. The apparatus of claim 12 wherein the radio frequency transmitter comprises an amplitude modulation radio frequency transmitter.

16. The apparatus of claim 15 wherein the amplitude modulation radio frequency transmitter comprises a short-range transmitter.

17. The apparatus of claim 11 wherein the modulated wireless signal transmitter comprises an optical signal transmitter.

18. The apparatus of claim 11 wherein the modulated wireless signal transmitter comprises an audio signal transmitter.

19. The apparatus of claim 1 wherein the audible speech output device comprises at least a first speaker and a second speaker.

20. The apparatus of claim 1 wherein a first speaker is disposed proximal to the movable barrier control system component.

21. The apparatus of claim 20 wherein a second speaker is disposed distal to the movable barrier control system component.

22. The apparatus of claim 1 wherein the memory has stored therein digitized speech content.

23. The apparatus of claim 1 wherein the memory has stored therein text content.

24. The apparatus of claim 23 wherein the audible speech output device comprises a text-to-speech synthesizer.

25. The apparatus of claim 1 wherein the at least one predetermined message comprises information regarding an operating condition as corresponds to the movable barrier control system.

26. The apparatus of claim 1 wherein the at least one predetermined message comprises information that explains a given action of the an automated movable barrier control system.

27. The apparatus of claim 26 wherein the information explains a given action of the movable barrier control system.

28. The apparatus of claim 1 wherein the at least one predetermined message comprises installation instructions as correspond to installation of the movable barrier control system.

29. The apparatus of claim 1 wherein the at least one predetermined message comprises information regarding the movable barrier control system component.

30. The apparatus of claim 1 wherein the at least one predetermined message comprises information that is unrelated to the movable barrier control system component.

31. The apparatus of claim 1 wherein at least one predetermined message comprises a question.

32. The apparatus of claim 1 wherein the plurality of predetermined messages comprise a same message content as delivered by different voices.

33. The apparatus of claim 1 wherein the plurality of predetermined messages comprise a same substantive message content as delivered with alternative wording.

34. The apparatus of claim 1 wherein the plurality of predetermined messages comprise a same substantive message content as delivered in alternative languages.

35. The apparatus of claim 1 wherein the first message corresponds to a first operational state of at least some aspect of the movable barrier control system and the second message corresponds to a second operational state of at least some aspect of the movable barrier control system, wherein the first and second operational states are different from one another.

36. The apparatus of claim 1 wherein the first and second movable barrier control system components are different from one another with respect to at least one of:

an on-board operating system;

an on-board operating system version;

an on-board user interface capability;

a brand of manufacture;

a product model;

a characterizing trademark.

37. The apparatus of claim 1 wherein the speech content comprises a system user's speech information.

38. The apparatus of claim 1 wherein the speech content comprises a celebrity's speech information.

39. The apparatus of claim 1 wherein the speech content comprises gender recognizable speech content.

40. The apparatus of claim 39 wherein the gender recognizable speech content comprises male voice speech content.

41. The apparatus of claim 39 wherein the gender recognizable speech content comprises female voice speech content.

42. The apparatus of claim 1 and further comprising an audio information input device operably coupled to the movable barrier control system component.

43. The apparatus of claim 42 wherein the audio information input device comprises a speech recognition input device.

44. The apparatus of claim 42 wherein the speech recognition input device comprises a speaker-independent speech recognition input device.

45. The apparatus of claim 42 wherein the speech recognition input device comprises a speaker-dependent speech recognition input device.

46. A method of using a movable barrier operator system, the method comprising:

effecting alteration of at least one operational aspect of the movable barrier operator system via a movable barrier control system component operably coupled to an audible speech output device, the movable barrier control system component comprising a fixed-location remote control user interface separate from and in responsive communication with a movable barrier operator;

the audible speech output device operably coupled to the movable barrier control system component to be actively responsive to communications received from the movable barrier operator to produce an audible signal, the audible signal having an informational content associated with at least two system operational aspects of the movable barrier control system and not associated with interactive speech recognition activity of the moveable barrier control system; and memory that operably couples to the audible speech output device, the memory including speech content which includes a plurality of predetermined messages which comprise at least a first message as corresponds to first substantive content and a second message as corresponds to second substantive content, wherein the first and second substantive content are different from one another and wherein the first message corresponds to a first movable barrier control system component and the second message corresponds to a second movable barrier control system component, wherein the first and second movable barrier control system components are different from one another.

47. The method of claim 46 wherein the method includes effecting the alteration using a predetermined speech message regarding a predetermined trigger event.

48. The method of claim 47 wherein the predetermined speech message comprises providing a message regarding a cause of the predetermined trigger event.

49. The method of claim 47 wherein the predetermined speech message comprises providing a message regarding an operational state of at least a portion of the movable barrier operator system.

50. The method of claim 49 wherein the message regarding an operational state of at least a portion of the movable barrier operator system is in regard to a present operational state of the at least a portion of the movable barrier operator system.

51. The method of claim 47 wherein the effecting the alterations uses a plurality of predetermined speech messages that relate to information regarding installation of at least some portion of a movable barrier operator system.

52. The method of claim 46 wherein the movable barrier control system component is configured to change the operational aspect of a movable barrier operator and which change is related to the audible signal from the audible speech output device.

53. The method of claim 46 wherein the predetermined speech content associated with at least two aspects of the movable barrier operator system and not related to interactive speech recognition activity comprises at least one of the group consisting of:

information regarding an operating condition;

information that explains a given action of the movable barrier control system;

information regarding the movable barrier control system component; and information comprising a warning regarding the movable barrier control system.

54. The method of claim 46 wherein the predetermined speech content associated with at least two aspects of the movable barrier operator system and not related to interactive speech recognition activity comprises at least one of the group consisting of:

speed of movement of the barrier;

present maximum force settings;

motor temperature;

availability of electrical power;

operational linkage between the movable barrier operator and one or more remote interfaces;

obstacle detection results;

vacation mode settings;

confirmation of calibration actions;

measured values;

user-input acknowledgement;

operational status information;

calculated battery life expectancy;

authentication data;

communications statistics;

a warning regarding at least one of an obstacle in a path of a movable barrier, excessive motor temperature, excessive applied force, excessive movable barrier speed of movement, and unauthorized movement of a movable barrier.

55. A method for use in a movable barrier operator system, the method comprising:

effecting alteration of at least one operational aspect of the movable barrier operator system via a wall-mounted remote controller operably coupled to an audible speech output device, the alteration affecting the at least one operational aspect selected from the group consisting of:
maximum force settings;
time settings;
operational linkage between the movable barrier operator and one or more remote interfaces;
vacation mode settings;
calibration actions; and
authorization data;

the wall mounted controller operably coupled to the audible speech output device, the wall mounted controller comprising a fixed-location remote control user interface separate from and in responsive communication with a movable barrier operator;

the audible speech output device operably coupled to the wall mounted controller to be actively responsive to communications received from the movable barrier operator to produce an audible signal, the audible signal having an informational content associated with at least two system operational aspects of the movable barrier control system and not associated with interactive speech recognition activity of the moveable barrier control system;

memory that operably couples to the audible speech output device, the memory including speech content which includes a plurality of predetermined messages which comprise at least a first message as corresponds to first substantive content and a second message as corresponds to second substantive content, wherein the first and second substantive content are different from one another and wherein the first message corresponds to a first movable barrier control system component and the second message corresponds to a second movable barrier control system component, wherein the first and second movable barrier control system components are different from one another.

56. The method of claim 55 wherein the speech content included in the memory comprises at least one of the group consisting of:
information regarding an operating condition;
information that explains a given action of the movable barrier control system;
information regarding the movable barrier control system component; and
information comprising a warning regarding the movable barrier control system.

57. The method of claim 55 wherein the speech content comprises at least one of the group consisting of:
speed of movement of the barrier;
present maximum force settings;
motor temperature;
availability of electrical power;
operational linkage between the movable barrier operator and one or more remote interfaces;
obstacle detection results;
vacation mode settings;
present maximum force settings;
confirmation of calibration actions;
measured values;
user-input acknowledgement;
operational status information;
calculated battery life expectancy;
authentication data;
communications statistics;
a warning regarding at least one of an obstacle in a path of a movable barrier, excessive motor temperature, excessive applied force, excessive movable barrier speed of movement, and unauthorized movement of a movable barrier.

58. An apparatus including a movable barrier control system, the apparatus comprising:

a movable barrier control system component operably coupled to an audible speech output device, the movable barrier control system component comprising a fixed-location remote control user interface separate from and in responsive communication with a movable barrier operator;

the audible speech output device operably coupled to the movable barrier control system component to be actively responsive to communications received from the movable barrier operator to produce an audible signal, the audible signal having an informational content associated with at least two system operational aspects of the movable barrier control system and not associated with interactive speech recognition activity of the moveable barrier control system;

memory that operably couples to the audible speech output device, the memory including speech content which includes a plurality of predetermined messages which comprise at least a first message as corresponds to first substantive content and a second message as corresponds to second substantive content, wherein the first and second substantive content are different from one another and wherein the first message corresponds to a first movable barrier control system component and the second message corresponds to a second movable barrier control system component, wherein the first and second movable barrier control system components are different from one another, the movable barrier control system component configured to effect an operation of the movable barrier control system and alteration of at least one of the system operational aspects of the movable barrier control system.

59. The apparatus of claim 58 wherein the movable barrier control system component comprises a movable barrier operator.

60. The apparatus of claim 58 wherein the fixed-location remote control user interface comprises a wall-mounted remote control user interface.

61. The apparatus of claim 58 wherein the fixed-location remote control user interface comprises a wireless fixed-location remote control user interface.

62. The apparatus of claim 58 wherein the fixed-location remote control user interface comprises a hard-wired fixed-location remote control user interface.

63. The apparatus of claim 58 wherein the audible speech output device and the movable barrier control system component share a common housing.

64. The apparatus of claim 58 wherein the audible speech output device comprises a digitized voice audible speech output device.

65. The apparatus of claim 58 wherein the audible speech output device comprises a synthesized voice audible speech output device.

66. The apparatus of claim 58 wherein the audible speech output device comprises a speaker.

67. The apparatus of claim 58 wherein the audible speech output device comprises an electrical signal output port.

68. The apparatus of claim 58 wherein the audible speech output device comprises a modulated wireless signal transmitter.

69. The apparatus of claim 58 wherein the movable barrier control system component is configured to change the operational aspect of a movable barrier operator and which change is related to the audible signal from the audible speech output device.

70. The apparatus of claim 58 wherein the audible signal comprises informational content which comprises a transitional state that changes with a present operation of the movable barrier control system.

71. The apparatus of claim 58 wherein the audible signal having the informational content related to the at least two operational system settings of the movable barrier control system relates to changes in the at least two system settings.

72. The apparatus of claim 58 wherein the informational content associated with at least two operational aspects of the movable barrier control system comprises at least one of the group consisting of:

information regarding an operating condition;
information that explains a given action of the movable barrier control system;
information regarding the automated movable barrier control system component; and
information comprising a warning regarding the movable barrier control system.

73. The apparatus of claim 58 wherein the informational content associated with at least two aspects of the movable barrier control system comprises at least one of the group consisting of:

speed of movement of the barrier;
present maximum force settings;
motor temperature;
availability of electrical power;
operational linkage between the movable barrier operator and one or more remote interfaces;
obstacle detection results;
vacation mode settings;
confirmation of calibration actions;
measured values;
user-input acknowledgement;
operational status information;
calculated battery life expectancy;
authentication data;
communications statistics;
a warning regarding at least one of an obstacle in a path of a movable barrier, excessive motor temperature, excessive applied force, excessive movable barrier speed of movement, and unauthorized movement of a movable barrier.

74. The apparatus of claim 58 wherein the audible speech output device is further configured to produce an informational content comprising at least one of the group consisting of:

information regarding an operating condition;
information that explains a given action of the movable barrier control system;
information regarding the movable barrier control system component; and
information comprising a warning regarding the movable barrier control system.

75. The apparatus of claim 58 wherein the audible speech output device is further configured to produce an informational content associated with the system operational aspects comprising at least one of the group consisting of:

speed of movement of the barrier;
present maximum force settings;
motor temperature;
availability of electrical power;
operational linkage between the movable barrier operator and one or more remote interfaces;
obstacle detection results;
vacation mode settings;
present maximum force settings;
confirmation of calibration actions;
measured values;
user-input acknowledgement;
operational status information;
calculated battery life expectancy;
authentication data;
communications statistics;
a warning regarding at least one of an obstacle in a path of a movable barrier, excessive motor temperature, excessive applied force, excessive movable barrier speed of movement, and unauthorized movement of a movable barrier.

* * * * *

UNITED STATES PATENT AND TRADEMARK OFFICE

CERTIFICATE OF CORRECTION

PATENT NO. : 8,494,861 B2
APPLICATION NO. : 10/843237
DATED : July 23, 2013
INVENTOR(S) : Robb et al.

It is certified that error appears in the above-identified patent and that said Letters Patent is hereby corrected as shown below:

IN THE CLAIMS:

Claim 26, Column 10, Line 41: Change "the an automated" to -- the --; and

Claim 72, Column 15, Line 20: After "the" delete "automated".

Signed and Sealed this
Thirteenth Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,494,861 B2
APPLICATION NO. : 10/843237
DATED : July 23, 2013
INVENTOR(S) : Eric J. Robb et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1235 days.

Signed and Sealed this
Third Day of February, 2015

Michelle K. Lee

Michelle K. Lee
*Deputy Director of the United States Patent and Trademark Office*